US006569210B1

(12) United States Patent
Chao et al.

(10) Patent No.: US 6,569,210 B1
(45) Date of Patent: May 27, 2003

(54) GAS JET REMOVAL OF PARTICULATED SOIL FROM FABRIC

(75) Inventors: Sidney C. Chao, Manhattan Beach, CA (US); Edna M. Purer, Los Angeles, CA (US); Nelson W. Sorbo, Redondo Beach, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/353,511

(22) Filed: Jul. 14, 1999

(51) Int. Cl.[7] ..... D06B 13/00; D06F 43/00

(52) U.S. Cl. ..... 8/137; 8/142; 8/149.2; 8/158; 8/159; 134/34; 134/37

(58) Field of Search ..... 8/137, 142, 158, 8/159, 149.2; 134/37, 10, 34; 510/278; 68/5 C, 183

(56) References Cited

U.S. PATENT DOCUMENTS

| | | | | |
|---|---|---|---|---|
| 3,563,693 | A | | 2/1971 | Cohen |
| 3,568,477 | A | | 3/1971 | Dixon |
| 3,733,715 | A | | 5/1973 | Hales |
| 3,906,756 | A | | 9/1975 | Bone |
| 4,457,042 | A | | 7/1984 | Jones et al. |
| 4,908,149 | A | | 3/1990 | Moore |
| 5,037,485 | A | | 8/1991 | Chromecek et al. |
| 5,467,492 | A | * | 11/1995 | Chao et al. |
| 5,587,021 | A | * | 12/1996 | Hoersch et al. |
| 5,651,276 | A | * | 7/1997 | Purer et al. |
| 5,718,729 | A | | 2/1998 | Harris |
| 5,876,516 | A | * | 3/1999 | Miller et al. |
| 5,891,198 | A | * | 4/1999 | Pearlstein |

FOREIGN PATENT DOCUMENTS

| | | |
|---|---|---|
| DE | 28 06 450 A | 8/1979 |
| GB | 1 462 011 A | 1/1977 |

* cited by examiner

*Primary Examiner*—Margaret Einsmann
(74) *Attorney, Agent, or Firm*—Colin M. Raufer; Leonard A. Alkov; Glenn H. Lenzen, Jr.

(57) ABSTRACT

Fabrics are cleaned by treating at least a portion of the piece of fabric with a particulating chemical, and agitated by a gas jet of a particle-dislodging gas to dislodge the particulated soil. The particulating chemical loosens embedded non-particulate soil and converts it to a particulate form, which is then separated from the fabric by the particle-dislodging gas.

24 Claims, 2 Drawing Sheets

GAS JET REMOVAL OF PARTICULATED SOIL FROM FABRIC

BACKGROUND OF THE INVENTION

This invention relates to the cleaning of fabrics, and, more specifically, to an approach for removing non-particulate and particulate soil from fabric using a gas jet technique.

Garment dry cleaning is currently performed using organic solvents such as perchloroethylene or petroleum derivatives. These solvents pose a health hazard, are smog-producing, and/or are flammable. The use of dense-phase carbon dioxide (both liquid and supercritical) as a dry-cleaning solvent medium resolves the health and environmental concerns posed by conventional solvents. An additional benefit is that its use reduces secondary waste streams associated with processes that use conventional solvents. A dry-cleaning process that uses liquid carbon dioxide as a cleaning medium is described in U.S. Pat. No. 5,467,492. In one embodiment, the fabric is placed into a perforated basket within a pressure vessel, and then submerged into a pool of liquid carbon dioxide. The liquid carbon dioxide and the fabric in the pool are agitated by an incoming flow of liquid carbon dioxide that promotes a tumbling action of the fabric. The liquid carbon dioxide solvent promotes the removal of the soluble soils through their dissolution, and the mechanical action of the fabric tumbling promotes the expulsion of the soils that are particulate in nature (e.g., sand, dust, food particles, etc.).

One of the disadvantages of this liquid carbon dioxide process is that it must be performed within a pressure system, and thus has associated high capital costs. An apparatus and method are described in U.S. Pat. No. 5,651,276 to expel particulate soils from fabrics by gas jets at ambient pressure. This gas jet process may be practiced using the apparatus of the liquid carbon dioxide process described above, as a step of an overall fabric dry-cleaning process, or in a separate, low-cost apparatus. This approach has the disadvantage, when used by itself, that soluble and/or non-particulate type soils are not removed.

In the current commercial dry-cleaning process, localized soils and stains are chemically treated and the spots are removed on a spotting board, prior to processing the entire garment in the dry-cleaning machine. This localized soil removal from fabrics is termed "spotting", and it involves the use of steam, and/or solvents to dissolve the soluble soils, and/or chemical agents to alter their composition. Once the soil alteration has occurred, the loosened soil is typically flushed and vacuumed out of the fabric. This procedure is performed manually and is labor intensive.

There is a need for an approach that realizes the advantages of the gas jet process, while permitting the removal of non-particulate soils in a commercially satisfactory and inexpensive manner. The present invention fulfills this need, and further provides related advantages.

SUMMARY OF THE INVENTION

The present invention provides a gas jet method for cleaning fabric that removes both non-particulate soil and particulate soil. Only a single processing apparatus is required, and both the non-particulate soil and the particulate soil are removed using that apparatus. The approach of the invention operates at atmospheric pressure within the gas jet processing container, and with moderate gas pressure. With this approach and its associated apparatus, gas jet cleaning of both particulate and non-particulate soil may be accomplished on either a commercial scale, as in a dry-cleaning establishment, or on a home scale. The approach is less labor intensive than conventional dry cleaning, and does not utilize the organic solvents used in dry cleaning and spotting.

The present invention provides an approach whereby soiled areas of fabric are first treated with a particulating chemical that loosens embedded non-particulate soil in a manner that renders it particulate in nature, and thus removable when exposed to a gas jet agitation process. In accordance with the invention, a method for cleaning fabrics comprises the steps of providing a piece of fabric, treating at least a portion of the piece of fabric with the particulating chemical, and agitating the entire piece of fabric with a gas jet to dislodge particulates therefrom. The gas jet dislodges and expels from the fabric both the soil that was initially particulate and the soil that has been rendered particulate by the particulating chemical. It is desirable to include an anti-static compound in the treatment to prevent redeposition of dislodged soil back onto the fabric and to prevent the fabric from tangling under the effects of the gas jet.

The particulating chemical may be of any operable type that dislodges an embedded non-particulate soil and converts the non-particulate soil into a particulate soil. The particulating chemical may be general in effect, and functional with a wide range of types of non-particulate soil, or may be selective to particulate a narrow range of types of non-particulate soils such as one or a few specific types of stains. After treatment with the particulating chemical, the article is then contacted with the particle dislodging gas to remove the particulated stain material as well as any previously present particulate soil. The particulating chemical is selected to be consistent with other features of the process, such as safety, biodegradability, and environmental acceptability.

This approach operates faster than conventional water/detergent cleaning, and in many cases is far more effective. The particulated non-particulate soil does not redeposit on the fabric in adjacent areas, as is often observed in conventional cleaning of difficult-to-clean stains. Only a single apparatus, operating at ambient pressure and with modest gas pressure, is required. The labor-intensive spotting process of conventional dry cleaning is avoided. After pretreatment, the non-particulate soil is removed in the general cleaning operation. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
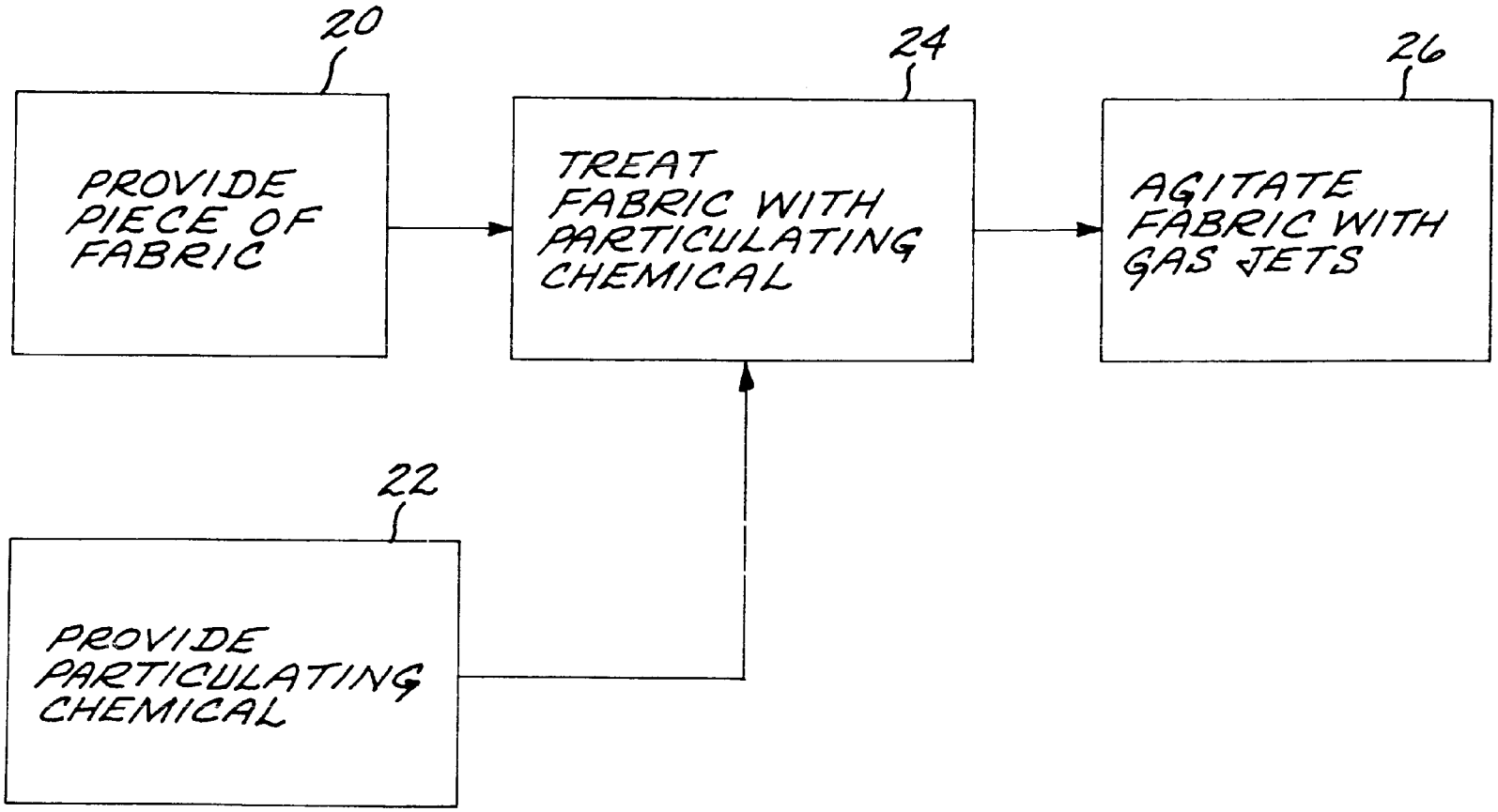
FIG. 1 is a block flow diagram of an approach for practicing the present invention.

FIG. 1 depicts a preferred approach for practicing the fabric cleaning method of the invention. A piece of fabric is provided, numeral 20. The fabric may be of any operable type, including both woven and nonwoven fabrics. The fabric may be of a wide variety of weights and thread densities. Typically, the greater the weight and the greater the thread density, the higher the pressure drop across the gas jet nozzles utilized in a subsequent step.

A particulating chemical is provided, numeral 22. The particulating chemical causes a non-particulate soil to be loosened from the fabric and converted into a particulate-soil form, usually in the absence of a liquid phase. An advantage of the invention is that it is very flexible in the selection of the particulating chemical. For example, a single general particulating chemical may be used, a special-purpose specific particulating chemical may be used, different particulating chemicals may be used in different pieces of fabric that are subsequently processed together, different particulating chemicals may be used in the same portion of one piece of fabric, different particulating chemicals may be used in different portions of the same piece of fabric, or the fabric may be generally treated. Any combination of these approaches may be employed.

The particulating chemical may be of any operable type that dislodges an embedded non-particulate soil and converts the non-particulate soil into a particulate soil. The particulating chemical may be general in function, for example water that loosens water-soluble non-particulate soil, or a water-miscible organic solvent such as an aliphatic alcohol that functions to dislodge and particulate most generally encountered greases and oils. The particulating chemical may instead be specific in function, as for example a particulating chemical that is specific to the particulating of an identified non-particulate soil or stain. In one example, a colorless sulfonated dye site blocker such as those disclosed in U.S. Pat. Nos. 4,501,591; 4,592,940; 4,908,149; and 4,699,812 is used to dislodge and particulate a specific stain. The aliphatic sulfonic acid cleaning compounds, both alkyl and alkenyl, in the preferred range of C8–C24 as disclosed in U.S. Pat. No. 4,699,812 are particularly preferred. The particulating chemical is selected to be consistent with other features of the process, specifically safety, biodegradability, and environmental acceptability. The particulating chemicals are often furnished as liquids, but they are used only to moisten the fabric and not as a general cleaning medium as in a conventional washing machine.

The fabric is treated with the particulating chemical, step 24, by any operable approach. The fabric may be treated locally in identified soiled areas, or the fabric may be treated generally over a wide area. Typically, the particulating chemical is applied to the fabric by spraying, dipping, rubbing, or other operable approach that achieves full contact of the particulating chemical to the fabric. The particulating chemical is allowed to remain in contact with the fabric for a period of time so that the conversion from non-particulate soil to particulate soil may occur. During this period, the non-particulate soil is loosened from the fabric and concentrated at the surface of the fabric in a particulate form. The length of time required for the particulating chemical to function depends upon the particulating chemical, the nature of the fabric, and the type and concentration of the non-particulate soil.

A foaming agent optionally may be applied to the fabric with the particulating chemical in step 24. Foaming agents are known in the art. A preferred foaming agent is sodium lauroyl sarcosinate, marketed as Secosyl by Stephan Co. When a foaming agent is used, the foaming agent aids in floating the loosened and particulated non-particulate soil to the surface of the fabric, where the foaming agent dries or evaporates and leaves the particulated non-particulate soil as a surface deposit that is subsequently removed.

The treated fabric is agitated by a gas jet of a particle-dislodging gas, numeral 26. The gas jet dislodges and expels the particles from the fabric, causing them to separate from the fabric. The dislodged particles include both the soil initially present as particles, and the soil that is converted from a non-particulate form to a particulate form in the treating step 24. This simultaneous removal of the original particulate soil and the particulated non-particulated soil is significant. Conventional dry cleaning practice requires that the spotting to remove non-particulate soils be completed first, followed by the general dry cleaning operation to remove particulate soils. In the present case, the treated fabric is agitated by the gas jet in a single operation to remove both the non-particulate soil and the particulate soil, reducing cleaning costs.

The agitating step 26 is typically performed after the treating step 24 is completed. That is, the fabric is first treated in step 24. Then, after a period of time elapses during which the particulating chemical functions, the agitating step 26 is performed.

However, in some cases the treating step 24 and the agitating step 26 may be performed simultaneously. That is, a fast-acting particulating chemical may be applied to the fabric substantially simultaneously with the agitation of the fabric with the gas jet. The particulating chemical may be applied with one set of nozzles, for example, while the gas jet is introduced through another set of nozzles. Equivalently for this purpose, the particulating chemical may be entrained in the gas jet stream.

The particle-dislodging gas forming the gas jet may be of any operable gas and at any operable gas pressure. Preferred gases include air, a component of air such as nitrogen, or another benign gas such as carbon dioxide. The particle-dislodging gas is preferably furnished and used in the gaseous phase, its most inexpensive form. The particle-dislodging gas may instead be furnished in a condensed solid or liquid phase, and then vaporized. The preferred gas pressure drop across the gas jet nozzle is from about 30 pounds per square inch (psi) to about 300 psi.

The duration of the agitating step 26 depends upon the nature of the apparatus used, the nature and extent of the soiling, and the size of the load of fabric being processed. Typically for a normal load of fabric in the apparatus discussed next in relation to FIG. 2, the exposure time is 30 seconds to 5 minutes. This exposure time is considerably shorter than required for conventional dry cleaning or wet washing, and the fabric leaves the processing dry and fresh smelling.

Additives may be introduced during the step of agitating 26. Typically, an anti-static compound may be introduced during the step of agitating 26. The antistatic compound may be entrained into the gas jets of the particle-dislodging gas or introduced separately, or the fabric may be treated with the antistatic compound prior to the agitating step 26. The anti-static compound aids in dissipating the static electricity generated by shear during gas flow and particulate dislodgment. The static electricity, if not dissipated in this way, tends to cause the fabric to adhere to itself, resulting in twisting of the fabric so that the gas jets do not have clear line-of-sight access to all regions of the fabric. Static electricity in the fabric could also cause the particulate to re-deposit onto the fabric. The introduction of anti-static compounds is therefore desirable to improve the cleaning performance of the apparatus 30. Examples of operable anti-static compounds include, but are not limited to, alcohol ethoxylates, alkylene glycol, or glycol esters.

Other additives may also be introduced during the step of agitating 26. For example, an odorizing compound may be contacted to the fabric to impart a pleasant odor to the fabric. Examples of odorizing compounds are perfumes, and essential natural or synthetic oils.

Figure 2:
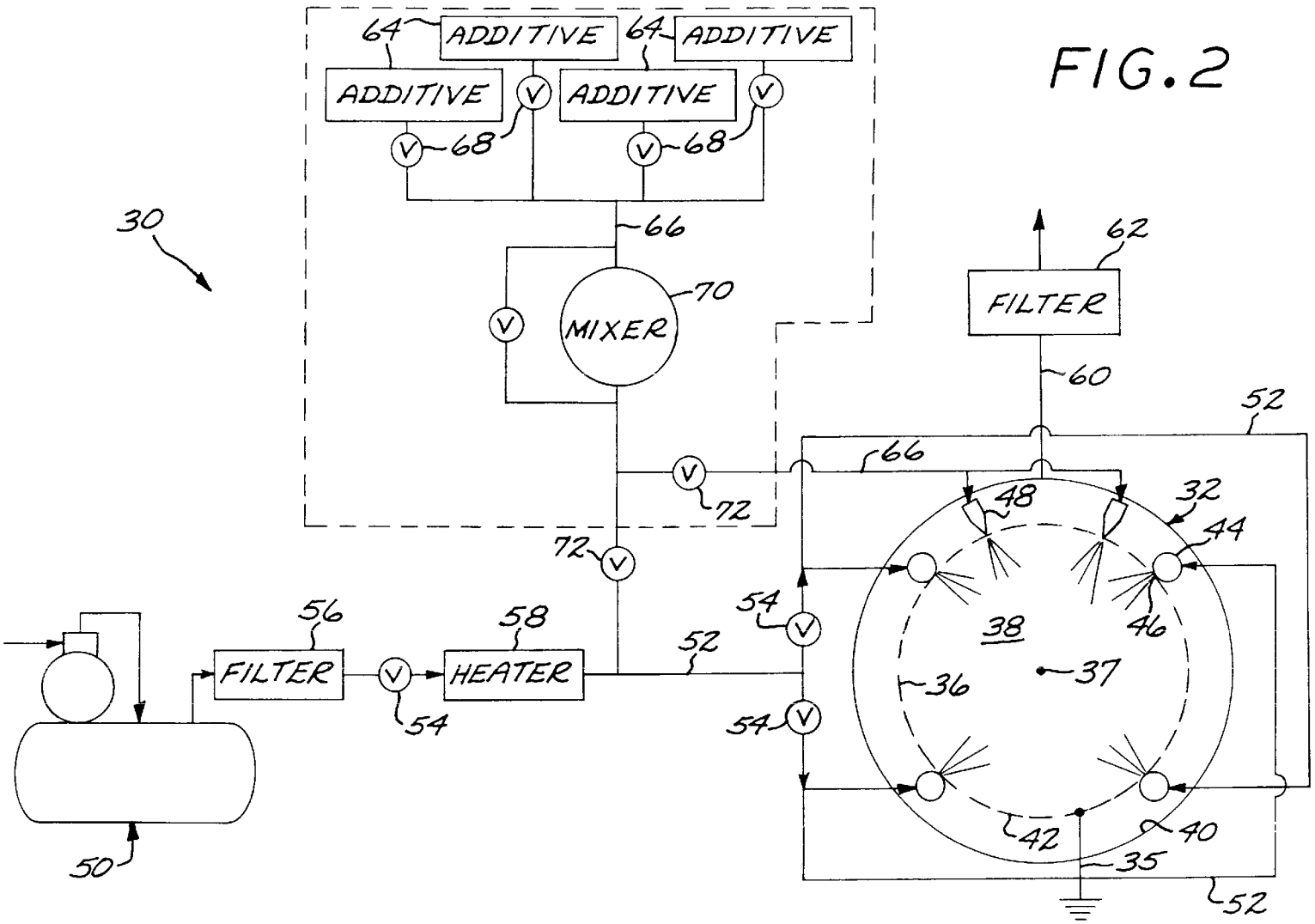
FIG. 2 is a schematic view of an apparatus for agitating fabric with a gas jet at the fabric.

The present inventors are interested in commercial and home application of the invention, and a practical commercial and home apparatus 30 that may be used in the agitating step 26 is illustrated in FIG. 2. The apparatus 30 includes a contacting chamber 32 with a perforated basket 36 therein. The perforated basket 36 is electrically grounded by a ground 35. The contacting chamber 32 and the perforated basket 36 are cylindrical in cross section with a cylindrical axis 37 (extending out of the plane of the illustration). The perforated basket 36 is smaller in cylindrical diameter than the contacting chamber 32. The perforated basket 36 may optionally be mounted on a rotational support for rotation about the cylindrical axis 37 and provided with a rotation drive motor to permit it to be rotated in the manner of a conventional clothes dryer. When such a rotational capability is provided, during the agitating step 26 of the present invention the perforated basket 36 may optionally be locked into a fixed position, or the perforated basket 36 may be rotated while the gas jets function.

The fabric which is to be agitated by the gas jets is placed into an interior 38 of the perforated basket 36. There may also be provided a cabinet that encloses the contacting chamber 32, and an exterior door in the cabinet to allow access to the interior 38 of the perforated basket 36.

Positioned between an inner surface 40 of the contacting chamber 32 and an outer surface 42 of the perforated basket 36 is at least one, and preferably several, gas jet manifolds 44. In the preferred cylindrical design, the gas jet manifolds 44 extend parallel to the cylindrical axis 37. The manifolds 44 may be affixed to the outer surface 42 of the perforated basket 36, affixed to the inner surface 40 of the contacting chamber 32, or separately supported. Preferably, the manifolds 44 are affixed to the outer surface 42 of the perforated basket 36, so that they may be rotated with the perforated basket 36 about the axis 37. A number of gas jet nozzles 46 are provided in each manifold, with the gas flows from the nozzles 46 directed inwardly into the interior 38 of the perforated basket 36 through the perforations. The manifolds 44 and gas jet nozzles 46 are positioned to promote reversible garment agitation to prevent garment roping, tangling, and strangling during the agitating step 26. Rotation of the perforated basket 36 can also aid in this effort. In the agitating step 26, the particle-dislodging gas flows through the manifolds 44, through the nozzles 46, and into the interior 38 of the perforated basket 36 to contact the fabric.

Preferably, at least one injector 48 is also provided and directed inwardly into the interior 38 of the perforated basket 36 through the perforations. As with the manifolds 44, it is preferred that the injectors 48 are affixed to the outer surface 42 of the perforated basket 36, with the flows from the injectors 48 directed through perforations in the perforated basket 36. Any additives, such as an anti-static compound and/or an odorizing compound, that are contacted to the fabric during the agitating step 26 may be introduced through the injectors 48. Such additives may instead be entrained into the particulate-dislodging gas and introduced through the nozzles 46.

The particulate-dislodging gas is pressurized by a compressor 50 (or supplied from a pressurized gas bottle or condensed gas source, not shown) and supplied to the manifolds 44 through a first piping system 52. The first piping system 52 includes manually operated or processor-controlled valves 54 to distribute the gas flow and, optionally, a filter 56 to filter the incoming gas and a heater 58 to heat the incoming gas to a desired temperature. The particulate-dislodging gas is pressurized by the compressor 50, flows through the first piping system 52 to the manifolds 44, is introduced into the interior 38 of the perforated basket 36 through the nozzles 46, and flows out of the contacting chamber 32 through an exit pipe 60. A particulate filter 62 removes the particulate from the gas flowing in the exit pipe 60, so that it is not released into the air and the environment.

Additives such as anti-static compounds and/or odorizing compounds are supplied to the injectors 48 from additive sources 64 through a second piping system 66. The second piping system 66 includes manually operated or processor-controlled valves 68 to select the types and amounts of the additives, a mixer 70 as necessary, and manually operated or processor-controlled valves 72 to distribute the additives to the injectors 48 and/or to the manifolds 44 as desired. Any additives that are not reacted with the fabric in the interior 38 of the perforated basket 36 leave the contacting chamber 32 through the exit pipe 60 and are entrapped in the exit filter 62.

In a preferred manner of operation, the fabric is treated in step 24, allowed to stand for a period of time to permit the particulating chemical to function, and then placed into the interior 38 of the perforated basket 36. The gas jets are operated by passing gas through the manifolds 44 and nozzles 46, agitating the fabric to dislodge particulate matter from the fabric. The gas jets entrain the fabric into the gas flow and promote the particle expulsion from the fabric. The additives, where used, are simultaneously added through the injectors 48. The particulate matter dislodged from the fabric is entrained into the gas flow leaving the contacting chamber 32, passes into the exit pipe 60, and is entrapped in the exit filter 62.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for cleaning fabrics, comprising the steps of:

providing a gas jet contacting chamber having a gas jet manifold and a gas jet nozzle therein;

providing a piece of fabric having non-particulate soil therein;

converting the non-particulate soil to a particulated form that remains in contact with the fabric;

placing the piece of fabric into the gas jet contacting chamber; and agitating the entire piece of fabric with a gas jet of a particle-dislodging gas to dislodge particulates therefrom, the step of agitating being performed in an ambient-pressure gaseous environment within the gas jet contacting chamber.

2. The method of claim 1, wherein the step of converting includes the step of treating at least a portion of the piece of fabric with a particulating chemical which converts the non-particulate soil to a particulated form that remains in contact with the fabric, and wherein the particulating chemical is a general effect chemical which is not selective as to the type of non-particulate soil which is converted to particulate form.

3. The method of claim 1, wherein the step of converting includes the step of treating at least a portion of the piece of fabric with a particulating chemical which converts the non-particulate soil to a particulated form that remains in contact with the fabric, and wherein the particulating chemical is a selective chemical as to the type of non-particulate soil which is converted to particulate form.

4. The method of claim 1, wherein the step of converting includes the step of treating at least a portion of the piece of fabric with a particulating chemical which converts the non-particulate soil to a particulated form that remains in contact with the fabric, and wherein the particulating chemical is water.

5. The method of claim 1, wherein the step of converting includes the step of treating at least a portion of the piece of fabric with a particulating chemical which converts the non-particulate soil to a particulated form that remains in contact with the fabric, and wherein the particulating chemical is a water-miscible organic solvent.

6. The method of claim 1, wherein the step of converting includes the step of treating at least a portion of the piece of fabric with a particulating chemical which converts the non-particulate soil to a particulated form that remains in contact with the fabric, and wherein the particulating chemical is a colorless sulfonated dye site blocker.

7. The method of claim 1, wherein the step of converting includes the step of treating at least a portion of the piece of fabric with a particulating chemical which converts the non-particulate soil to a particulated form that remains in contact with the fabric, and wherein the step of treating includes the step of applying a foaming agent in addition to but with the particulating chemical.

8. The method of claim 1, wherein the particle-dislodging gas is selected from the group consisting of air, nitrogen, and carbon dioxide.

9. The method of claim 1, wherein the particle-dislodging gas is forced from a gas jet under a pressure drop of from about 30 to about 300 pounds per square inch.

10. The method of claim 1, wherein the step of agitating is performed after the step of converting.

11. The method of claim 1, wherein the step of agitating and the step of converting are performed simultaneously.

12. The method of claim 1, including an additional step, performed simultaneously with the step of agitating, of contacting an anti-static compound to the piece of fabric.

13. The method of claim 1, wherein the step of converting includes the step of treating at least a portion of the piece of fabric with a particulating chemical, and wherein the particulating chemical is a chemical other than water.

14. The method of claim 1, wherein the method does not utilize any dry cleaning solvents.

15. A method for cleaning fabrics, comprising the steps of:

providing a gas jet contacting chamber having a gas jet manifold and a gas jet nozzle therein;

providing a piece of fabric having particulate soil and non-particulate soil therein;

converting the non-particulate soil to a particulated form that remains in contact with the fabric, the step of converting including the step of treating at least a portion of the piece of fabric with a particulating chemical that converts the non-particulate soil to a particulate form that remains in contact with the fabric;

placing the piece of fabric into the gas jet contacting chamber; and agitating the entire piece.of fabric with a particle-dislodging gas jet flowing from the gas jet nozzles to dislodge particulates therefrom in the presence of an anti-static compound, wherein the particle-dislodging gas is forced from a gas jet under a pressure drop of from about 30 to about 300 pounds per square inch, the step of agitating being performed in a gaseous environment within the gas jet contacting chamber, the fabric being dry at the completion of the step of agitating.

16. The method of claim 15, wherein the particulating chemical is a general effect chemical which is not selective as to the type of non-particulate soil which is converted to particulate form.

17. The method of claim 15, wherein the particulating chemical is a selective chemical as to the type of non-particulate soil which is converted to particulate form.

18. The method of claim 15, wherein the step of treating includes the step of applying a foaming agent with the particulating chemical.

19. The method of claim 15, wherein the particle-dislodging gas is selected from the group consisting of air, nitrogen, and carbon dioxide.

20. The method of claim 15, wherein the step of agitating is performed after the step of treating.

21. The method of claim 15, wherein the step of agitating and the step of treating are performed simultaneously.

22. The method of claim 15, wherein the particulating chemical is a chemical other than water.

23. A method for cleaning fabrics, comprising the steps of:

providing a gas jet contacting chamber having a gas jet manifold and a gas jet nozzle therein;

providing a piece of fabric having initially particulate soil and non-particulate soil therein;

converting the non-particulate soil to a particulated non-particulate soil that remains in contact with the fabric;

placing the piece of fabric into the gas jet contracting chamber; and agitating the entire piece of fabric with a particle-dislodging gas jet flowing from the gas jet nozzles to simultaneously dislodge the initially particulate and the particulated non-particulate soil therefrom in the presence of an anti-static compound, wherein the particle-dislodging gas is selected from the group consisting of air, nitrogen, and carbon dioxide and is forced from a gas jet under a pressure drop of from about 30 to about 300 pounds per square inch, the step of agitating being performed with the piece of fabric in a gaseous ambient-pressure environment within the contacting chamber.

24. The method of claim 23, wherein the step of converting the non-particulate soil to a particulated non-particulate soil that remains in contact with the fabric includes the step of converting the non-particulate soil to a particulated non-particulate soil that remains in contact with the fabric using a particulating chemical that is not water.

* * * * *